US010364477B2

(12) United States Patent
Kustas et al.

(10) Patent No.: US 10,364,477 B2
(45) Date of Patent: Jul. 30, 2019

(54) PROCESSES FOR PRODUCING CONTINUOUS BULK FORMS OF IRON-SILICON ALLOYS AND BULK FORMS PRODUCED THEREBY

(71) Applicant: Purdue Research Foundation, West Lafayette, IN (US)

(72) Inventors: Andrew Benjamin Kustas, Albuquerque, NM (US); Dinakar Sagapuram, Bryan, TX (US); Kevin Paul Trumble, West Lafayette, IN (US); Srinivasan Chandrasekar, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 144 days.

(21) Appl. No.: 15/247,322

(22) Filed: Aug. 25, 2016

(65) Prior Publication Data

US 2017/0058375 A1 Mar. 2, 2017

Related U.S. Application Data

(60) Provisional application No. 62/209,719, filed on Aug. 25, 2015.

(51) Int. Cl.
*C21D 8/02* (2006.01)
*C21D 9/46* (2006.01)
(Continued)

(52) U.S. Cl.
CPC ..... *C21D 9/46* (2013.01); *C21D 6/008* (2013.01); *C21D 8/0226* (2013.01);
(Continued)

(58) Field of Classification Search
None
See application file for complete search history.

(56) References Cited

U.S. PATENT DOCUMENTS 4,265,682 A 5/1981 Tsuya et al.
4,564,401 A 1/1986 Strichman et al.
(Continued)

FOREIGN PATENT DOCUMENTS

CN 103954638 A * 7/2014

OTHER PUBLICATIONS

Translation of CN 103954638 (published Jul. 2014) from Espacenet.*

*Primary Examiner* — George Wyszomierski
(74) *Attorney, Agent, or Firm* — Hartman Global IP Law; Gary M. Hartman; Domenica N. S. Hartman

(57) ABSTRACT

Processes for producing continuous bulk forms of iron-silicon alloys and bulk forms produced thereby. Such a bulk form is continuous in a longitudinal direction thereof and has a continuous cross-sectional form transverse to the longitudinal direction. The bulk form is formed of an Fe—Si alloy and has a crystallographic texture that comprises <111> and {110} fibers that are inclined relative to the longitudinal direction. The bulk form may be produced by a process that includes deforming a solid body formed of an Fe—Si alloy with a cutting tool in a single step to continuously produce a continuous bulk form from material obtained from the solid body.

12 Claims, 16 Drawing Sheets

(51) Int. Cl.

| | |
|---|---|
| ***C21D 6/00*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |

(52) U.S. Cl.
CPC ..... *C21D 8/0273* (2013.01); *C22C 38/002* (2013.01); *C22C 38/02* (2013.01); *C22C 38/04* (2013.01); *C22C 38/06* (2013.01)

(56) References Cited

U.S. PATENT DOCUMENTS

| | | | | |
|---|---|---|---|---|
| 4,649,983 | A | 3/1987 | Laxmanan et al. | |
| 4,906,530 | A * | 3/1990 | Nishiike | C21D 8/1277 148/307 |
| 5,002,728 | A | 3/1991 | Achikita et al. | |
| 5,205,872 | A * | 4/1993 | Mitsunori | C21D 8/12 117/10 |
| 5,308,411 | A | 5/1994 | Suga et al. | |
| 5,913,987 | A | 6/1999 | Sung et al. | |
| 7,617,750 | B2 | 11/2009 | Moscoso et al. | |
| 2005/0115643 | A1 * | 6/2005 | Fortunati | C21D 8/1222 148/111 |
| 2014/0017113 | A1 | 1/2014 | Chandrasekar et al. | |

* cited by examiner

PROCESSES FOR PRODUCING CONTINUOUS BULK FORMS OF IRON-SILICON ALLOYS AND BULK FORMS PRODUCED THEREBY

CROSS REFERENCE TO RELATED APPLICATIONS

This application claims the benefit of U.S. Provisional Application No. 62/209,719, filed Aug. 25, 2015, the contents of which are incorporated herein by reference.

STATEMENT REGARDING FEDERALLY SPONSORED RESEARCH

This invention was made with government support under Contract Nos. CMMI 1363524 and CMMI 1100712 awarded by the National Science Foundation. The government has certain rights in the invention.

BACKGROUND OF THE INVENTION

The present invention generally relates to methods of producing bulk forms with controllable microstructures. The invention particularly relates to a large-strain extrusion machining process capable of directly producing continuous sheets or strips of iron-silicon alloys that have controlled microstructures, including controlled crystallographic textures.

Electrical steel or iron silicon alloy (Fe—Si) sheets have long been utilized for their magnetic and electrical properties, most notably for the high magnetic permeability and electrical resistivity. Commercial processing of Fe—Si sheets is commonly done through combinations of multi-step hot and cold rolling, and their magnetic properties are routinely varied by controlling aspects of the commercial processing to produce thin profile (thickness (t) of about 0.3 mm) sheets with different microstructural features, i.e., different crystallographic textures and grain sizes. As known in the art, crystallographic texture refers to the degree to which grain crystal axes are aligned within a material.

In general, two distinct types of sheets having vastly different structures and magnetic properties have been produced. Sheets processed primarily by hot rolling are classified as non-grain-oriented (NGO) due to a weak (near random) crystallographic texture, while the application of iterative cold rolling and high temperature annealing is used to develop a strong cube-on-edge (Goss) texture resulting in grain-oriented (GO) sheets.

Both material structure and composition control the magnetic properties of Fe—Si sheets. Aspects of the material structure considered to significantly affect magnetic properties are the grain size (d) and crystallographic texture, the combination of which predominantly influences the magnetic permeability (μ), coercivity (Hc), and hysteresis loss (W) properties.

The main objective in developing textures in Fe—Si sheets is the influence on the orientation of the easy magnetization directions, along <001>. As represented in image (a) of FIG. 1, in the case of an NGO sheet, the texture is weak with a (near) random orientation of the <001> directions both in and out of the sheet plane, resulting in a low degree of anisotropy in the magnetic properties such that performance is nearly independent of the applied field (H) direction. NGO sheets are thus most commonly utilized in electric motor applications, where the field is rotating continuously. In contrast, GO sheets (image (b) of FIG. 1) possess a strong Goss texture from secondary recrystallization, wherein one of the <001> directions lies along the sheet length (rolling direction, RD), leading to near ideal magnetic properties in this direction (i.e., high permeability with low coercivity and hysteresis loss). GO sheets are primarily used in power distribution transformers, where the easy magnetization direction can be configured mostly parallel to the magnetic flux direction. GO sheets also exhibit a significantly larger grain size (d>4 mm), by virtue of the secondary recrystallization, compared to NGO sheets (d about 150 μm), although this characteristic is considered to contribute less than the texture to benefiting magnetic properties. As a whole, the goal of texture development in Fe—Si sheets is to reduce the misorientation of the <001> directions with respect to the applied H field.

In addition to structure, composition also influences the magnetic properties of Fe—Si sheets. Alloying with silicon significantly enhances the intrinsic magnetic properties of iron by increasing the permeability, while reducing coercivity, magnetostriction, and core losses. Commercial rolling, however, is limited to producing Fe—Si sheets with a narrow silicon composition range of about 1 to 3.5 weight percent Si, even though it is well-known that higher Si content alloys have superior magnetic properties. In fact, a Si content of about 6.5 wt. % is considered to be a preferred composition for many magnetic applications. However, major decreases in workability arise in alloys containing greater than 3.5 wt. % Si. Such alloys are generally brittle and have a greatly increased likelihood of cracking during rolling, which prevents their cost-effective manufacturing in the form of sheets.

Many attempts have been made to manufacture electrical steel strips/sheets with higher silicon content, including casting, hot forging, sputter deposition, spray forming, direct powder rolling, and CVD (chemical vapor deposition) siliconizing. All but the CVD siliconizing have yet to enter the commercial sector with any success and none have been able to replace the current Fe—Si (3 wt. %) rolled sheets that are predominantly available, despite inherently improved properties with higher silicon content.

In view of the above, it can be appreciated that there are certain problems, shortcomings or disadvantages associated with the prior art, and that it would be desirable if a method were available for manufacturing Fe—Si sheets in a more efficient manner and, if desired, with a higher silicon composition than is currently possible by rolling processes.

BRIEF DESCRIPTION OF THE INVENTION

The present invention provides processes for manufacturing Fe—Si alloys and bulk forms made therefrom having higher silicon compositions than currently possible by conventional rolling processes.

According to one aspect of the invention, a bulk form is provided that is continuous in a longitudinal direction thereof and has a continuous cross-sectional form transverse to the longitudinal direction. The bulk form is formed of an Fe—Si alloy and has a crystallographic texture that comprises <111> and {110} fibers that are inclined relative to the longitudinal direction.

According to another aspect of the invention, a process is provided that includes deforming a solid body formed of an Fe—Si alloy with a cutting tool in a single step to continuously produce a continuous bulk form from material obtained from the solid body. The continuous bulk form has a longitudinal direction, a continuous cross-sectional form, and a microstructure characterized by a crystallographic texture having <111> and {110} fibers that are inclined relative to the longitudinal direction.

According to another aspect of the invention, a process is provided that includes deforming a solid body formed of an Fe—Si alloy with a cutting tool in a single step to continuously produce a continuous bulk form from material obtained from the solid body. The continuous bulk form has a longitudinal direction, a continuous cross-sectional form, and a microstructure characterized by a crystallographic texture, wherein the crystallographic texture is determined by a deformation texture which is retained upon recrystallization.

Technical effects of the bulk form and process described above preferably include the ability to provide electrical steel products efficiently, with specific crystallographic texture, and if desired, having compositions with high Si contents for improved electrical and magnetic properties.

Other aspects and advantages of this invention will be better appreciated from the following detailed description.

DETAILED DESCRIPTION OF THE INVENTION

The following discussion is directed to processes by which continuous bulk forms, generally sheets or strips, of iron-silicon alloys can be produced by a large strain extrusion machining (LSEM) process. LSEM imposes large values of deformation strain (for example, shear strains of about one or more) in a single pass or stage. The preferred process can be carried out in a machining operation that combines the processes of chip formation and extrusion. Bulk forms produced by LSEM can be described as having a continuous cross-section, which refers to the generation of a cross-section that is substantially constant along the direction of extrusion, as opposed to referring to an uninterrupted cross-section transverse to the direction of extrusion. Such bulk forms can be produced from solid bodies such as castings (including cast ingots) as well as other various forms. For purposes of this disclosure the terms iron-silicon alloy(s) and Fe—Si alloy(s) will be used to refer to Fe—Si alloys that may optionally contain one or more additional elements such as, but not limited to, manganese, phosphorous, sulfur, aluminum, and other minor components commonly included in electrical steel alloys, wherein the total content of these additional elements is generally less than 2%.

Systems and techniques suitable for use with the present invention include those disclosed in U.S. Pat. No. 7,617,750 to Moscoso et al. and U.S. Patent Application Publication No. 2014/0017113 to Chandrasekar et al. (issued as U.S. Pat. No. 9,687,895), incorporated herein in their entirety by reference. Although the combined teachings of Moscoso et al. and Chandrasekar et al. may be read to imply that LSEM may be used on certain alloys having a BCC crystal structure, it was unexpected that LSEM would successfully produce continuous strips of Fe—Si alloys, particularly at Si contents at or above 3.5 wt. %, or that such strips would retain their deformation texture upon recrystallization (discussed below). In particular, the metals and alloys disclosed in Moscoso et al. and Chandrasekar et al. were capable of forming sheets via cold rolling. In contrast, Fe—Si alloys of higher Si content are not capable of being cold rolled into sheets, and can produce an unconventionally sharp texture after annealing and grain growth treatments, especially at high temperatures. The metals and alloys disclosed in Moscoso et al. and Chandrasekar et al. did not exhibit such sharp recrystallization/grain growth textures in a rolled sheet. Therefore, the present disclosure demonstrates continuous strip processing of alloys of distinctly lower workability than previously disclosed, particularly for Fe—Si alloys having Si contents above 3.5 wt. %.

Figure 1:
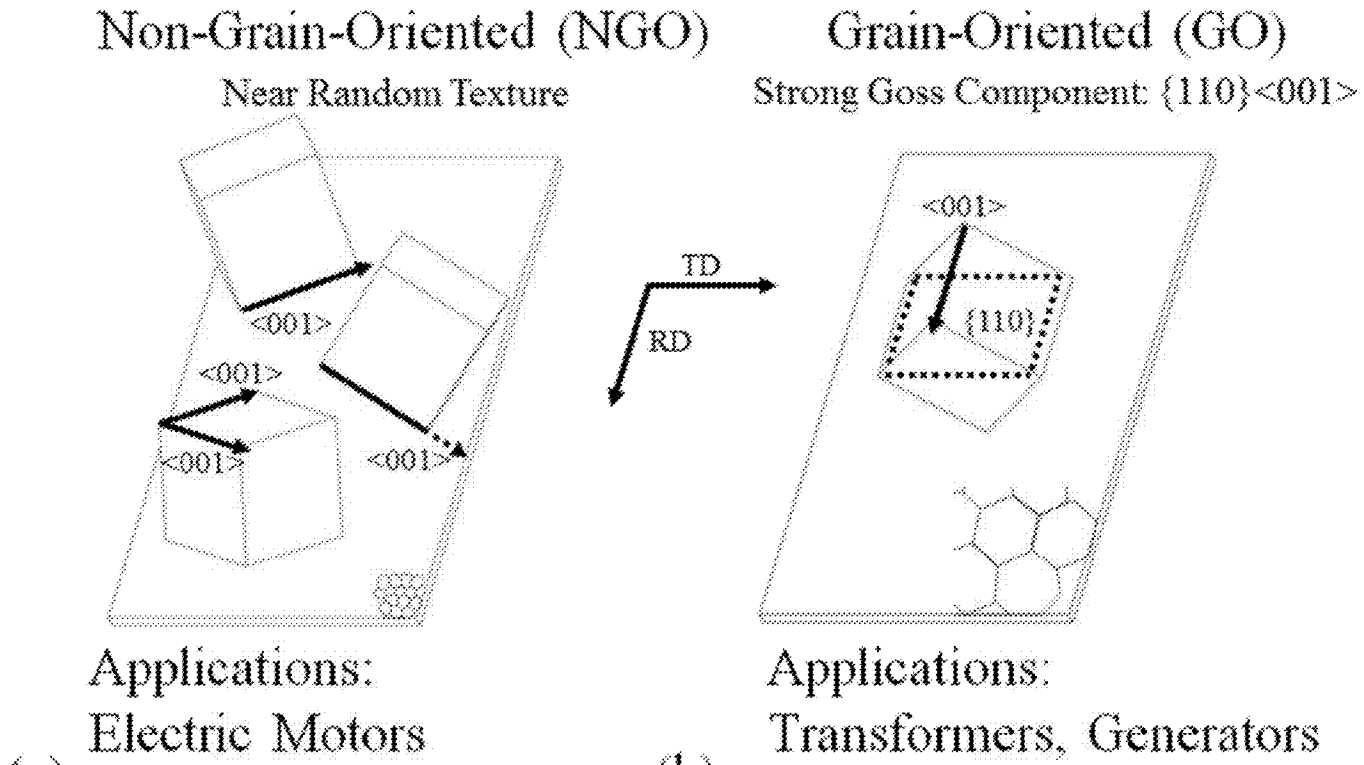
FIG. 1 includes two images (a and b) that schematically represent Fe—Si alloy sheets having non-grain-oriented (NGO) and grain-oriented (GO) sheet structures, respectively. Superimposed are the orientations of select <001> directions, which are responsible for vastly different sheet magnetic anisotropies between the two sheet structures.
Figure 2:
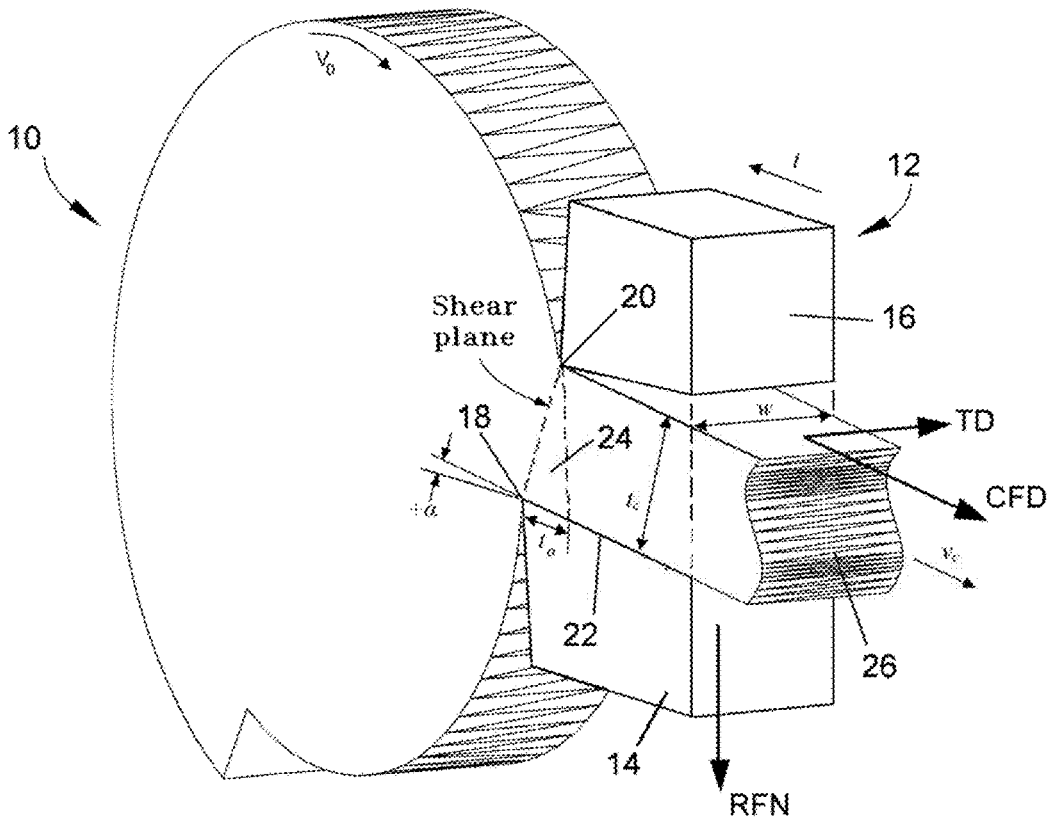
FIG. 2 schematically represents an extrusion-machining system adapted for simultaneously cutting and extruding material to produce an extrudate in accordance with a nonlimiting embodiment of this invention.

FIG. 2 schematically represents a system capable of carrying out an LSEM process of this invention through a combination of machining and extrusion processes performed in a single-stage operation. The operation is illustrated as a turning operation, such as on a lathe, in which a solid body (workpiece) 10 is rotated while a relatively stationary cutting tool assembly 12 is fed in a generally radial direction into the workpiece 10. While a turning operation is represented in FIG. 2, other machining operations are also within the scope of the invention, including others where relative movement between a workpiece and cutting tool is primarily through movement of the workpiece against a relatively stationary cutting tool, as well as linear machining operations in which relative movement between the workpiece and cutting tool is primarily through movement of the cutting tool against a relatively stationary workpiece, or vice versa. The workpiece 10 is a solid body that can be formed of iron-silicon alloys having various compositions and microstructures, and can be in a variety of forms, including but not limited to cast, wrought and PM (powder metallurgy) ingots.

As the tool assembly 12 is plunged into the workpiece 10 at a given feed rate t (m/rev) and the workpiece 10 rotates with a given surface velocity $V_0$ (m/s), material is cut and extruded from the workpiece 10, producing a long, continuous extrudate 26 of width (w) and thickness ($t_c$). Directions represented in FIG. 2 relative to the extrusion direction of the extrudate 26 include a rake face normal (RFN) direction, a chip-flow direction (CFD), and a transverse direction (TD).

The cutting tool assembly 12 is represented in FIG. 2 as including two members 14 and 16. In reference to the orientation depicted in FIG. 2, the lower member may be termed a cutting member 14 and defines a cutting edge 18 for cutting the workpiece 10, in which case the upper member in FIG. 2 may be termed a constraining member 16, which is shown as being wedge-shaped and defining a constraining edge 20 that constrains a volume of material being removed from the workpiece 10. The constrained volume of material, which may be referred to as an undeformed chip, is within a roughly triangular-shaped region that will be termed the primary deformation zone 24, and is bounded by a shear plane between the cutting and constraining edges 18 and 20 (where shear strain (γ) is imposed during chip formation) and two planes that extend from the cutting and constraining edges 18 and 20, respectively, and intersect along the rake face 22 a distance from the cutting edge 18 equal to the thickness ($t_o$) of the undeformed chip (corresponding to the depth of cut). Once the constrained volume of material is dislocated from its original location on the workpiece 10, the constraining member 16 imposes dimensional control over this material to form the extrudate 26. The constraining edge 20 of the constraining member 16 and the rake face 22 of the cutting member 14 define an opening within which the material obtained from the workpiece 10 is simultaneously constrained while being dislocated from the workpiece 10, thereby defining the size and shape of the resulting deformed extrudate 26 exiting the tool assembly 12.

Crystallographic textures within the extrudate 26 can be controlled by controlling a deformation thickness ratio of the LSEM process and controlling the localized deformation temperature by controlling the deformation velocity (with or without preheating of the bulk body) of the LSEM process. The deformation thickness ratio, denoted herein by $\lambda$, is the ratio of the thickness ($t_c$) of the continuous bulk form produced by the LSEM process to the undeformed thickness ($t_o$) of the material of the solid body prior to being subjected to the deformation conditions.

It should be appreciated that the size of the opening between the cutting and constraining edges 18 and 20 can be altered to produce a change in a deformation strain level induced in the material during deformation as a result of altering the deformation thickness ratio ($\lambda=t_c/t_o$). In the example represented in FIG. 2, the extrudate 26 has a cross-sectional shape with two orthogonal dimensions defining the thickness ($t_c$) and width (w) of the extrudate 26, and the deformation process is shown as inducing a change in only the thickness ($t_c$) of the extrudate 26.

Sufficiently large but controlled deformation strains ($\gamma$) and deformation temperatures ($T_{def}$) within the deformation zone 24 can be achieved to produce a desired microstructure, including crystallographic texture, within the extrudate 26. More particularly, deformation strains and temperatures can be controlled by modifying the geometry of the deformation zone 24 through suitable positioning of the constraining edge 20 relative to the cutting edge 18 and rake face 22 of the cutting tool assembly 12, as well as controlling the deformation velocity (corresponding to the surface velocity, $V_0$, of the workpiece 10).

Figure 3:
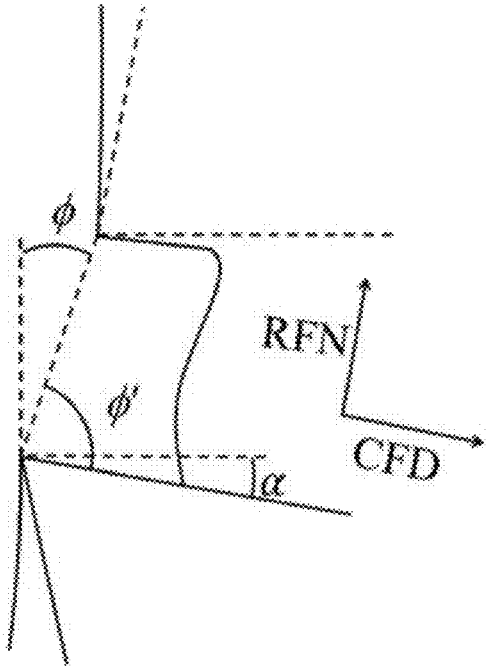
FIG. 3 schematically represents a partial side view of the deformation zone of FIG. 2 modeled as a single shear plane (due to its narrow width) with orientation "φ" relative to the cutting member. The orientation of the macroscopic shear plane prior to deformation may be given by $\varphi'=90°+\alpha-\varphi$, where $\varphi=\tan^{-1}(\cos\alpha/(\lambda-\sin\alpha))$. As φ' is a function of both α and λ, deformation conditions can be selected to produce a wide range of macroscopic shear plane orientations, influencing the deformation texture.

FIG. 3 schematically represents the deformation zone 24 of FIG. 2 modeled as a single shear plane (due to its narrow width) with orientation "$\varphi$" relative to the cutting member. The orientation of the macroscopic shear plane prior to deformation may be given by $\varphi'=90°+\alpha-\varphi$, where $\varphi=\tan^{-1}(\cos\alpha/(\lambda-\sin\alpha))$. As $\varphi'$ is a function of both $\alpha$ and $\lambda$, deformation conditions can be selected to produce a wide range of macroscopic shear plane orientations, influencing the deformation texture.

Figure 4:
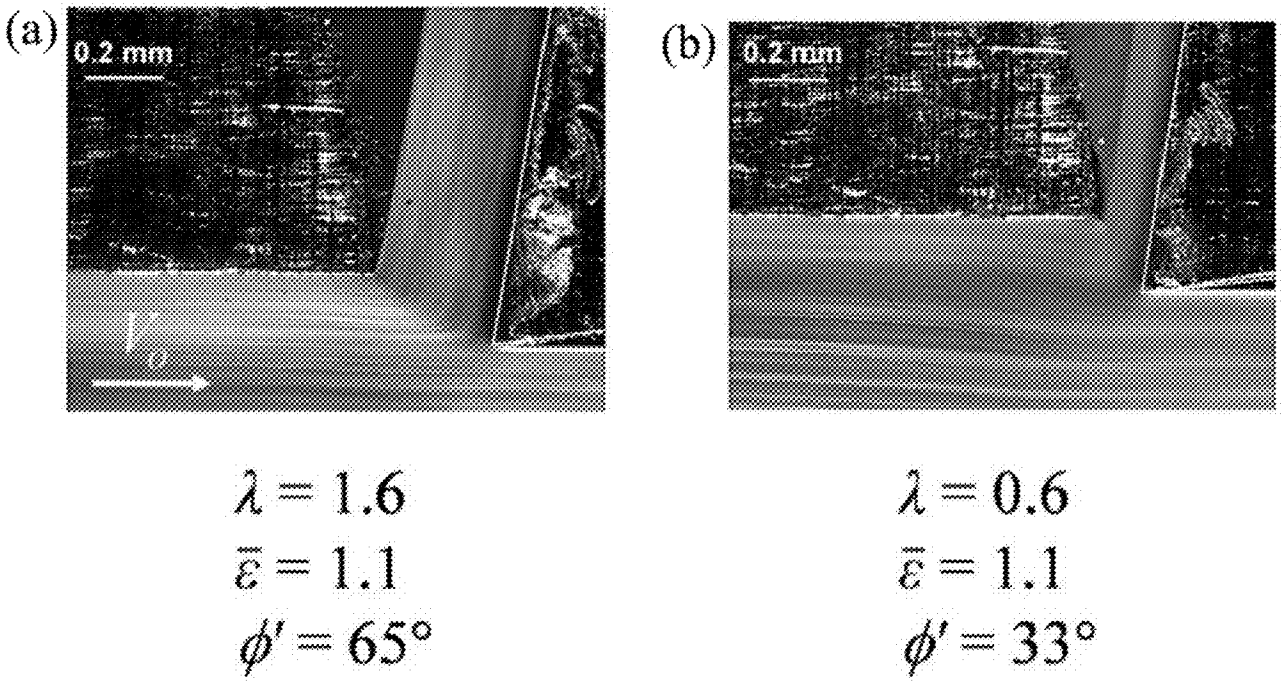
FIG. 4 includes two images (a and b) that represent side-views of an Fe—Si material, defined by chip flow direction (CFD) and rake face normal (RFN) axes, forming under large (image a; λ=1.6) and small (image b; λ=0.6) chip thickness ratios. The images represent material flow obtained by averaging two hundred consecutive images from a high-speed video recording during large strain extrusion machining (LSEM) (α=10°, and $V_0$=0.4 mm/s). Significant differences in the orientation of the macroscopic shear plane can estimated from such images.

FIG. 4 represents machining of an Fe—Si alloy via LSEM, defined by chip flow direction (CFD) and rake face normal (RFN) axes, forming under relatively large (image a; $\lambda=1.6$) and small (image b; $\lambda=0.6$) chip thickness ratios. The images represent material flow obtained by averaging two hundred consecutive images from a high-speed video recording during LSEM ($\alpha=10°$, and $V_0=0.4$ mm/s). Significant differences in the orientation of the macroscopic shear plane can be estimated from such images.

Certain investigations leading to the present invention and discussed below included the use of machining setups based on that schematically represented in FIG. 2.

Figure 5:
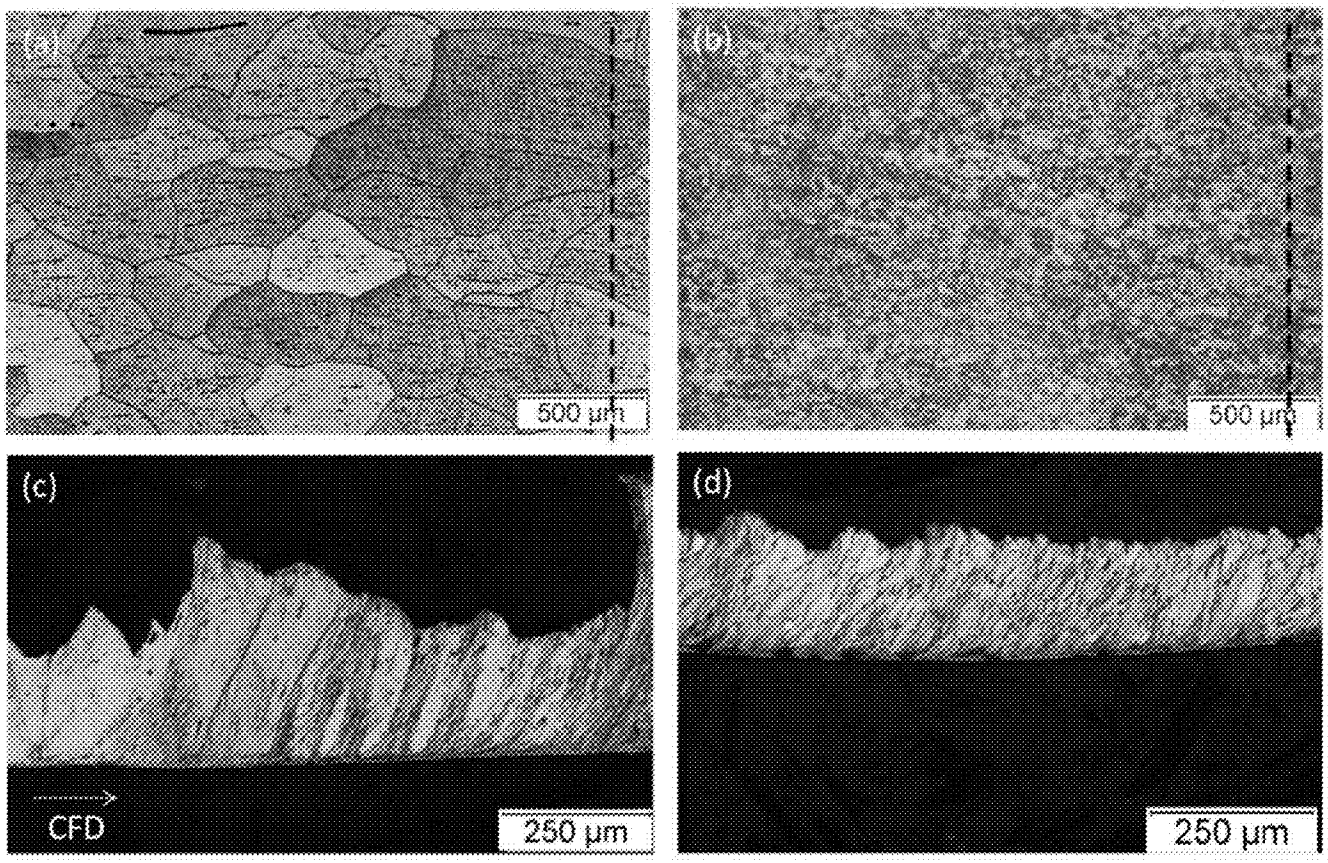
FIG. 5 includes four images (a, b, c, and d) that represent workpiece microstructure influence on the morphology of a strip produced by free machining a workpiece formed of an Fe—Si alloy with a Si content of 4 wt. %. Images (a) and (b) are micrographs showing starting workpiece microstructures of a coarse-grained plate produced by hot rolling (as-received), and a fine-grained plate produced by warm rolling and annealing, respectively. Dotted lines represent $t_0$ (i.e., depth of material removed in each pass). Images (c) and (d) are micrographs showing thickness cross-sections of chips produced from the corresponding workpieces of images (a) and (b), respectively, via free machining ($t_0$=0.13 mm, α=0°, and $V_0$=2 m/s).

Images (a) and (b) of FIG. 5 represent micrographs of solid bodies (workpieces) and chips produced therefrom by free machining. The workpieces were formed from an Fe—Si alloy comprising 3.83 wt. % Si, 0.32 wt. % Mn, 0.028 wt. % C, 0.018 wt. % P, 0.015 wt. % S, 0.006 wt. % Al, with the balance being Fe (for convenience, referred to herein as a 4 wt. % Fe—Si alloy). Image (a) is a micrograph of a first of the workpieces in the form of a hot-rolled plate (0.67 cm thick) with a coarse, equiaxed grain size (d) of about one millimeter. The large initial grain size and the higher-than-usual Si content were expected to reduce the workability of this alloy relative to a conventional electrical sheet steel (3 wt. % Si). Hence, it was not surprising that in free machining, the chip from this alloy exhibited inhomogeneous, flow-localized deformation as represented in image (c).

A section of the hot-rolled plate of image (a) was removed and subjected to a warm-rolling at $T_0$ of about 573 K (300° C.) to a reduction of about 60 percent, followed by annealing at 973 K (700° C.) for 30 minutes. This processing resulted in a second workpiece with a fine, equiaxed grain size of about 20 μm, as represented in image (b). The fine-grain size allowed for several grains to be encompassed in the machining deformation zone (i.e., $t_0$), resulting in more homogeneous deformation and reduced flow localization, as represented in image (d). As such, refining by warm rolling and annealing greatly reduced the inhomogeneity of the deformation structure. Therefore, the starting workpiece microstructure influenced the morphology of the strips produced therefrom by LSEM. Dotted lines in images (a) and (b) represent a commonly used initial depth of cut value ($t_0$=125 μm), which indicated small sections of individual crystal grains were removed from the coarse grain plate while several grains were deformed in the refined structure.

A series of experiments was conducted under different $\lambda$, $\alpha$, and $V_o$ conditions to characterize the microstructural evolution and texture. Unless otherwise noted, deformation was conducted under ambient conditions ($T_o$=RT). Due to the high hardness of the fine-grained workpiece (about 230 HV) deformation was accomplished by using cemented carbide cutting inserts. Annealing was done at 700° C. for thirty minutes in an open air box furnace to develop a primary recrystallized microstructure, similar to commercial Fe—Si alloy sheets.

Figure 6:
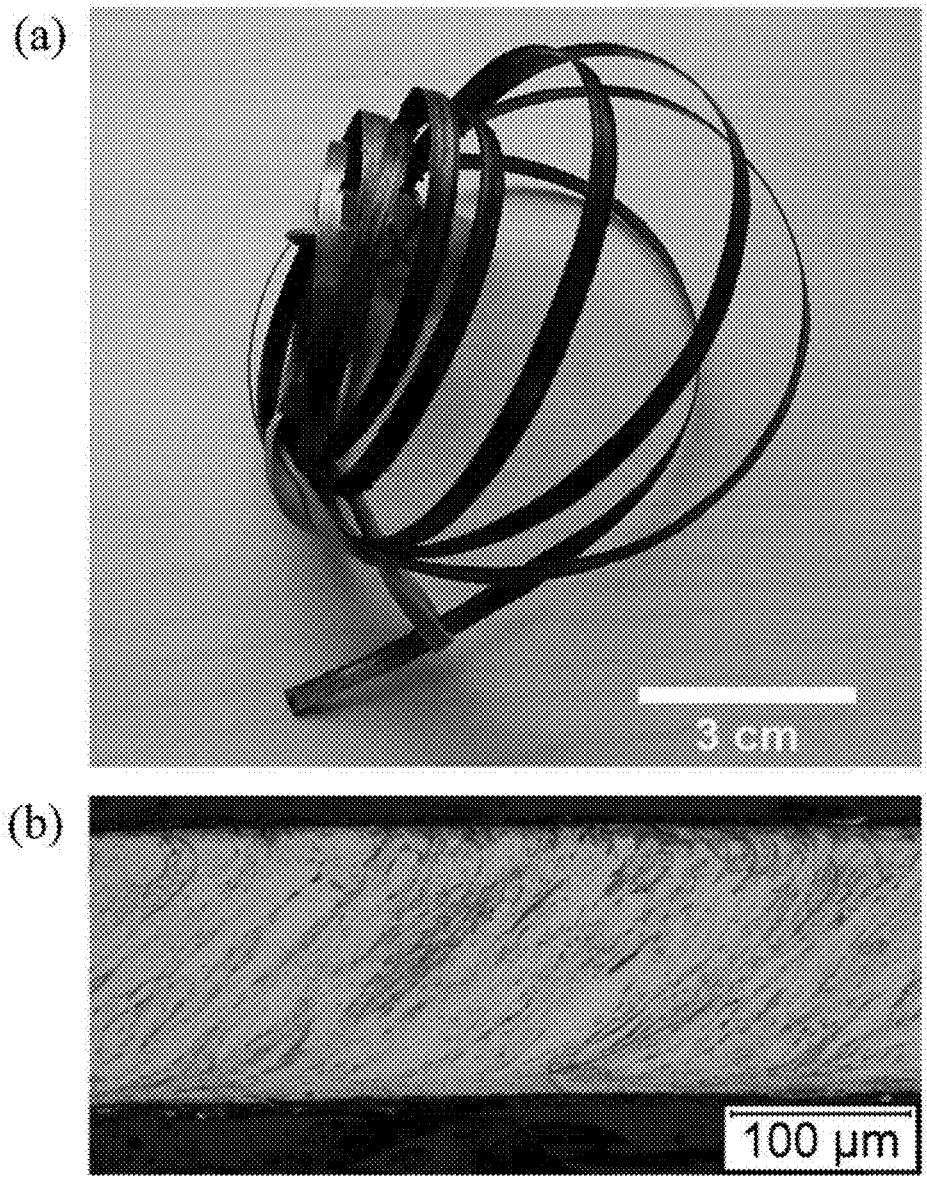
FIG. 6 includes two images (a and b) that represent a thin, narrow strip formed of an Fe—Si alloy having a Si content of 4 wt. % produced via LSEM (λ=1.7, $V_0$=1 m/s, and α=5°) without any workpiece preheating (image a), and a side view of its uniformly deformed microstructure (image b).

Chips produced by high-speed free machining of the Fe—Si alloy sheets showed considerable flow localization (segmentation, shear banding) and inhomogeneous microstructure. In contrast, FIG. 6 shows an example of a continuous sheet formed from a 4 wt. % Fe—Si alloy by LSEM, wherein flow localization was completely suppressed by employing both a large deformation thickness ratio ($\lambda=1.7$) and a relatively low cutting velocity ($V_0$=1 m/s). This particular LSEM deformation condition produced sheets with a final thickness, $t_c$ of about 1460 μm, which is similar to that of common electrical steel sheet thicknesses.

Figure 7:
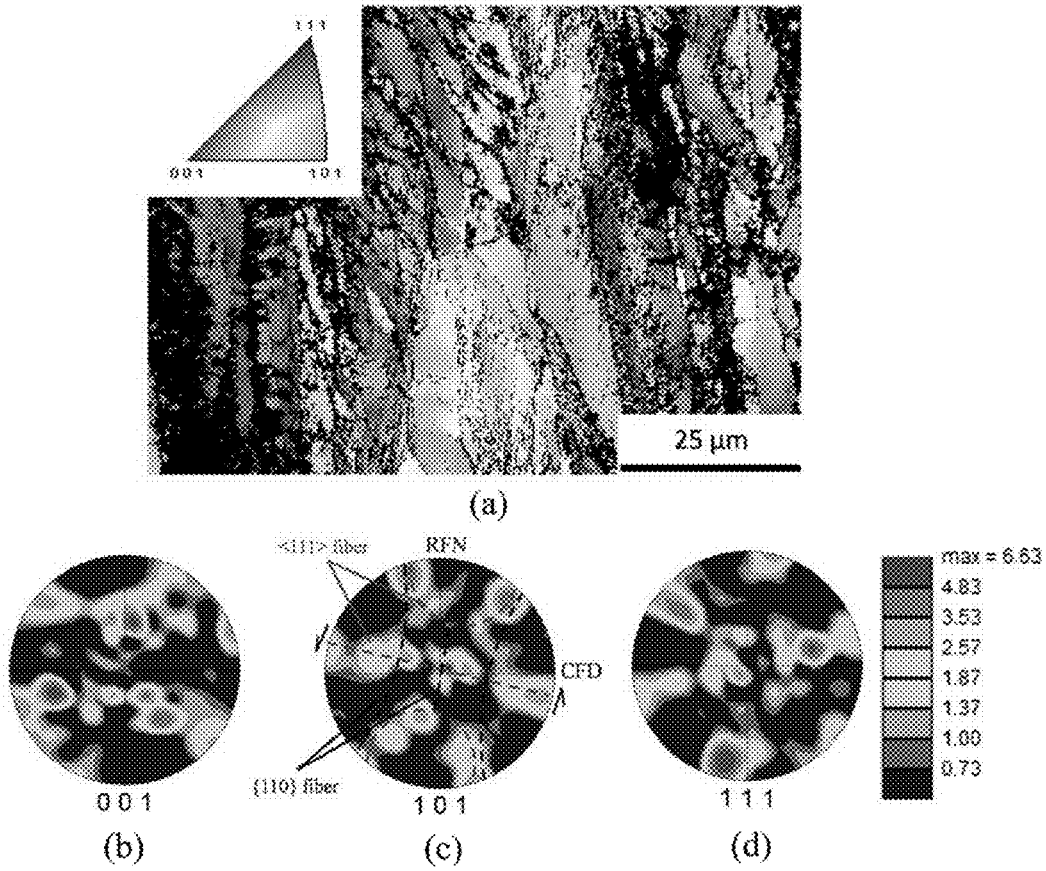
FIG. 7 includes four images (a, b, c, and d) representing a crystallographic texture of a sheet formed from a 4 wt. % Fe—Si alloy by LSEM (λ=2, $V_0$=2 m/s, and α=20°). Image (a) is an inverse pole figure color map showing the deformed structure with solid black areas representing regions of low confidence index values (<0.1). Images (b), (c), and (d) are pole figures with the {110} and <111> shear texture fibers highlighted in the (101) pole figures by dotted lines.

A homogeneous flow-line type microstructure was developed in the sheet with the flow lines aligned in the direction of maximum tensile strain imposed during the deformation; this direction is inclined at an angle to the shear plane, the angle being related to the imposed strain. FIG. 7 shows texture data from a similar sheet of homogeneous microstructure ($\lambda=2$, $V_0$=2 m/s). The texture is represented using the (100), (101) and (111) pole figures, obtained from the sheet thickness cross-section (RFN-CFD plane). It is predominantly characterized by two partial {110} and <111> fibers, highlighted by the dotted lines in the (101) pole figure for reference. These fibers are characteristic of simple shear deformation texture for BCC systems, including Fe—Si alloys. The {110} fiber with uniform intensity results from an alignment of the (110) plane in a direction parallel to the shear plane. This fiber also reflects orthotropic symmetry around the plane normal. Similarly, the <111> fiber arises from [111] aligning along the shear direction, with orthotropic symmetry around this direction. The angle by which these fibers are rotated (76°, counter-clockwise with respect to CFD in FIG. 7) corresponds closely with the shear plane orientation ($\varphi'=80°$) for this process condition.

Figure 8:
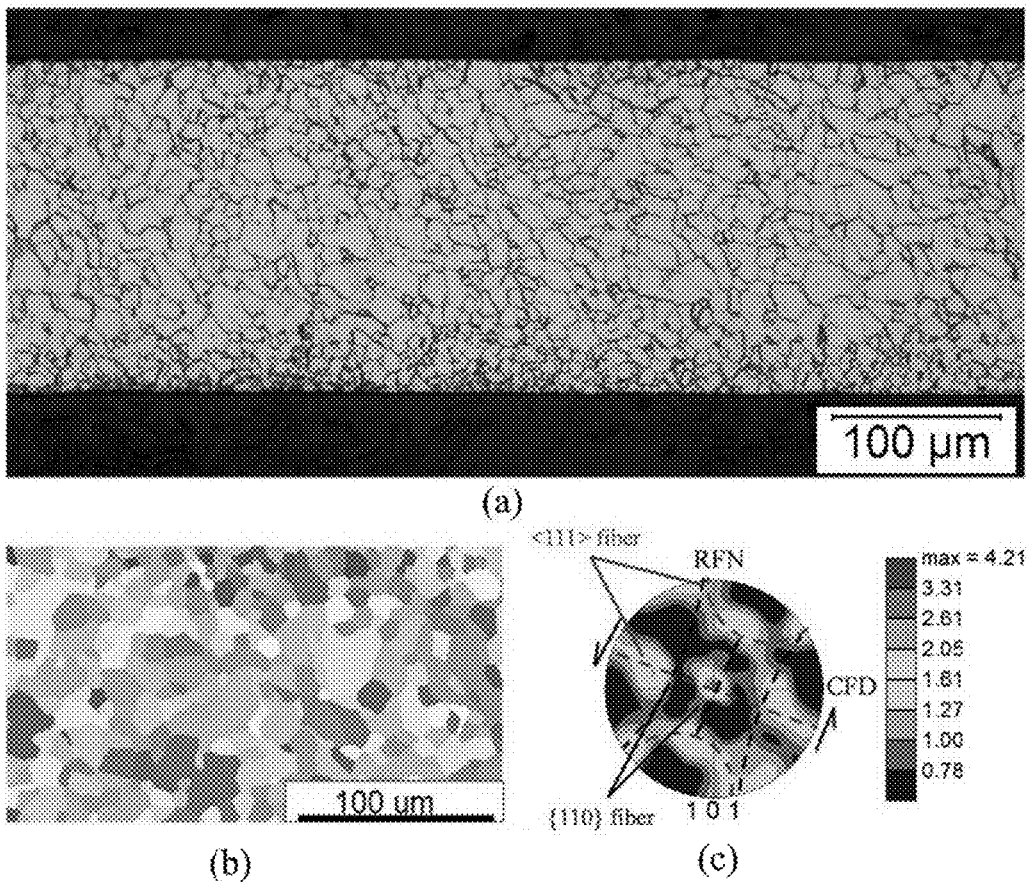
FIG. 8 includes three images (a, b, and c) representing dynamic recrystallization during simple shear deformation at high temperature. Image (a) is a micrograph of a dynamically recrystallized sheet. Image (b) is an inverse pole figure map and image (c) is a (101) pole figure for the recrystallized sheet (λ=1.2, α=5°, $V_0$=3 m/s, and $T_0$=573 K (300° C.)) showing fine-grained structure (d about 8 μm) and shear texture resembling the deformation texture shown in FIG. 7.

When the deformation temperature was increased by varying $T_0$ and $V_0$, a range of microstructures, characterized by different degrees of recrystallization, was found to develop in the sheet. A fully recrystallized microstructure with fine-grain size of about eight micrometers finally resulted at T=923 K (650° C.) ($T_0$=573 K (300° C.), $V_0$=3 m/s), as represented in FIG. 8. The structural characteristics clearly indicate that dynamic recrystallization had occurred in the deformation zone, even though the time for which a material element experienced the elevated temperature was only on the order of 100 μs (time to traverse the deformation zone). The texture components in the dynamically recrystallized sheet (FIG. 8) were found to be essentially the same as those in the sheet produced without pre-heating of the workpiece at this cutting condition, i.e., the deformation texture.

Figure 9:
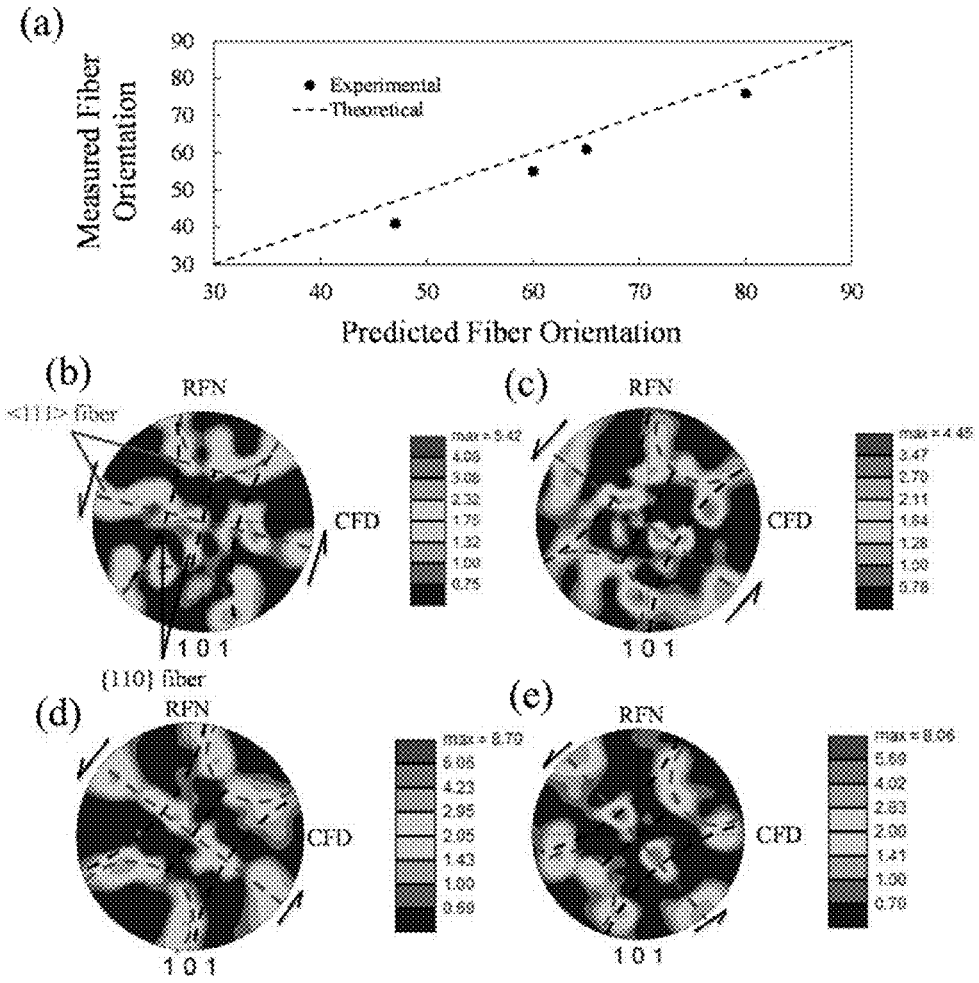
FIG. 9 includes five images (a, b, c, d, and e) for recrystallized strips formed of an Fe—Si alloy via LSEM. Image (a) is a plot representing predicted fiber orientation compared to measured fiber orientation. Images (b)-(e) are pole figures representing experimentally measured fiber orientation of recrystallized strips produced under various deformation conditions (λ=1 to 2, α=0 to 20°, $V_0$=0.25 to 2 m/s). The measured fiber orientations of images (b)-(e) are identified on the plot of image (a).

The simple shear (deformation) texture in the sheet also was observed to be retained even after static recrystallization at 973 K (700° C.); see the (101) pole figures of both FIGS. 7 and 9. The principal change during the recrystallization was a sharpening of the shear texture components (higher pole figure intensities). FIG. 9 represents a series of experiments wherein φ' was varied in the range of 41 to 76° by adjusting λ and α, and the texture was measured after static recrystallization. A close correspondence between the measured texture fiber orientations and φ' of the shear plane can be seen in the plot in FIG. 9, demonstrating the capability of engineering crystallographic texture in the sheet through direct control of the simple shear deformation. Taken as a whole, recrystallization texture evolution in the Fe—Si alloy was largely determined by the strain path underlying sheet formation, and was negligibly influenced by any post-process (recrystallization) annealing.

It was also noted that the machined surface of the workpiece experienced negligible subsurface deformation during LSEM. As a result, the residual workpiece texture was essentially unchanged after each cutting pass used to produce sheet. This is in contrast to Mg alloys, wherein significant subsurface deformation occurred in the workpiece following each cutting pass. In the latter case, the initial workpiece texture was substantially altered prior to entering the deformation zone; and these texture changes have to be considered in analysis of the final sheet microstructure.

Figure 10:
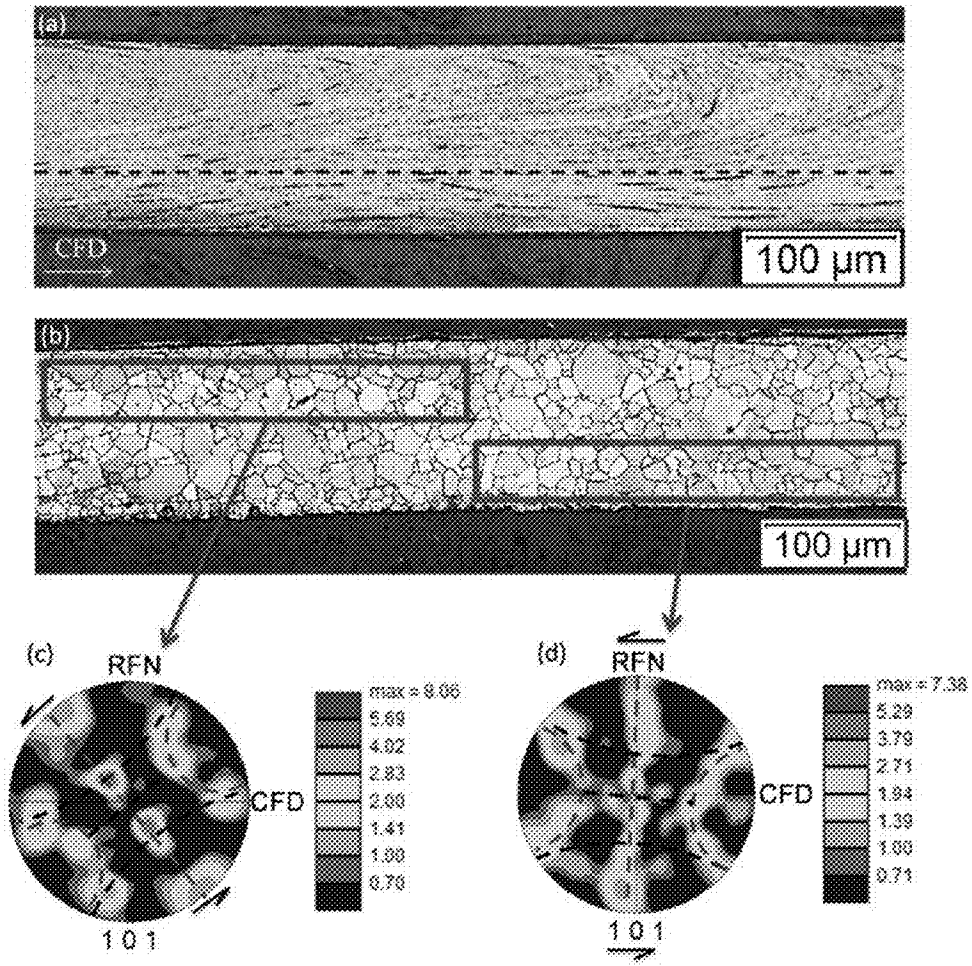
FIG. 10 includes four images (a, b, c, and d) of a sheet formed of an Fe—Si alloy via LSEM at a relatively low speed (α=5°, λ=1, $V_0$=0.25 m/s). Images (a) and (b) are micrographs of the sheet in as-deformed and annealed conditions, respectively. These images show evidence of secondary shear due to sliding at the tool-sheet interface (bottom). A dotted line in image (a) represents, approximately, the boundary of the secondary shear zone. Images (c) and (d) represent (101) pole figures of the local texture (within defined boxes) from the annealed condition (image b).

The textures of FIGS. 7 through 9 correspond to deformation conditions characterized by large λ and high $V_0$, wherein the bulk of the sheet is deformed by simple shear imposed at the shear plane (primary shear zone), and secondary shear effects are negligible. In order to explore the effects of secondary shear on texture in a sheet from a 4 wt. % Fe—Si alloy, a relatively low speed ($V_0$=0.25 m/s) condition at λ of 1 (small) was performed (FIG. 10). The sheet thickness cross-section in image (a) of FIG. 10 shows a fairly thick (about 0.3 $t_c$), secondary shear zone adjoining the (bottom) face of the sheet in contact with the cutting tool. In this zone, the flow lines are aligned nearly parallel to the sheet surface, a result of severe shear that is imposed nearly parallel to the contact surface.

Image (b) of FIG. 10 shows the recrystallized sheet microstructure, which is characterized by equiaxed grains having a size (d) of about 20 μm. The texture, obtained from two different locations (images c and d of FIG. 10), is characterized by two distinct fiber orientations, both corresponding to simple shear. In the region of the sheet far from the cutting member-sheet contact surface (primary shear zone), the fiber are oriented at an angle of 41° with respect to the CFD. This texture is due primarily to the deformation occurring at the shear plane, with the fibers closely aligning with φ' of 47° (image c). In the cutting member-sheet contact region (secondary shear zone), the fibers were aligned essentially parallel to the CFD, resulting from the secondary shear at the contact (image d). Such secondary shear effects at near-surface regions are unavoidable in any bulk metal forming operation (e.g., rolling, extrusion) that involves die-workpiece frictional contacts. In LSEM, however, the relative extents of the secondary and primary deformation textures can be controlled by appropriate selection of λ and $V_0$. As already noted, at large λ and high $V_0$, the primary deformation texture is described effectively by φ' (FIGS. 7 through 9), and is dominant in the sheet. At the other limit, small λ and low $V_0$, the secondary shear deformation texture (corresponding to φ'=0°) can be expected to prevail over a large fraction of the sheet thickness. Thus, by careful selection of λ and $V_0$, a gradation in the sheet texture may be produced, as in FIG. 10, complementing the uniformly textured sheet such as in FIGS. 8 and 9. Although grain size is known to influence texture development (by grain growth), there was no statistically significant difference in the grain size between the primary (11.7 μm±0.8) and secondary (11.0 μm±0.6) shear zones after the annealing.

Since workability in Fe—Si alloys is considerably reduced for Si content in excess of 3.5 wt. %, the capability of LSEM to process Fe—Si alloys with very high Si content was analyzed in exploratory experiments with an Fe—Si alloy having a content of about 6.5 wt. % Si (referred to herein as a 6.5 wt. % Fe—Si alloy). Such composition is believed to improve magnetic permeability, reduce core loss, and realize near-zero magnetostriction. However, this alloy is particularly difficult, if not impossible, to process into sheet by rolling as a result of its high silicon content.

The cast 6.5 wt. % Fe—Si alloy workpiece (image a of FIG. 11) exhibited a relatively uniform distribution of non-dendritic equiaxed grains (d of about 1 mm), similar to the grain size of the 4 wt. % Fe—Si alloy hot-rolled plate (image a of FIG. 5). By pre-heating ($T_0$=773 K (500° C.)) and using a small deformation thickness ratio (λ=1), sheet of 95 μm thickness ($t_c$) could be created directly from the cast ingot, as represented in image (b) of FIG. 11. The sheet cross-section shows a dynamically recrystallized microstructure with remarkable homogeneity (images b and c of FIG. 11). This recrystallization is a consequence of the high $T_0$ and confinement of the deformation heating. Both of these factors also enhance alloy workability in the deformation zone, along with the large hydrostatic pressure intrinsic to LSEM. The limited amount of porosity in the cast workpiece may have also promoted workability. These deformation and material related factors also inhibit segmentation in chip formation, another barrier to sheet processing. The observations suggest that it is feasible to produce continuous sheets of thickness similar to that used in electrical sheet steel applications from even 6.5 wt. % Fe—Si alloys by suitable design of the initial cast material microstructure and deformation parameters. Subsequent investigations determined that continuous sheets could be successfully produced from 6.5 wt. % Fe—Si alloys at room temperature ($T_0$=RT), that is, without pre-heating.

Figure 11:
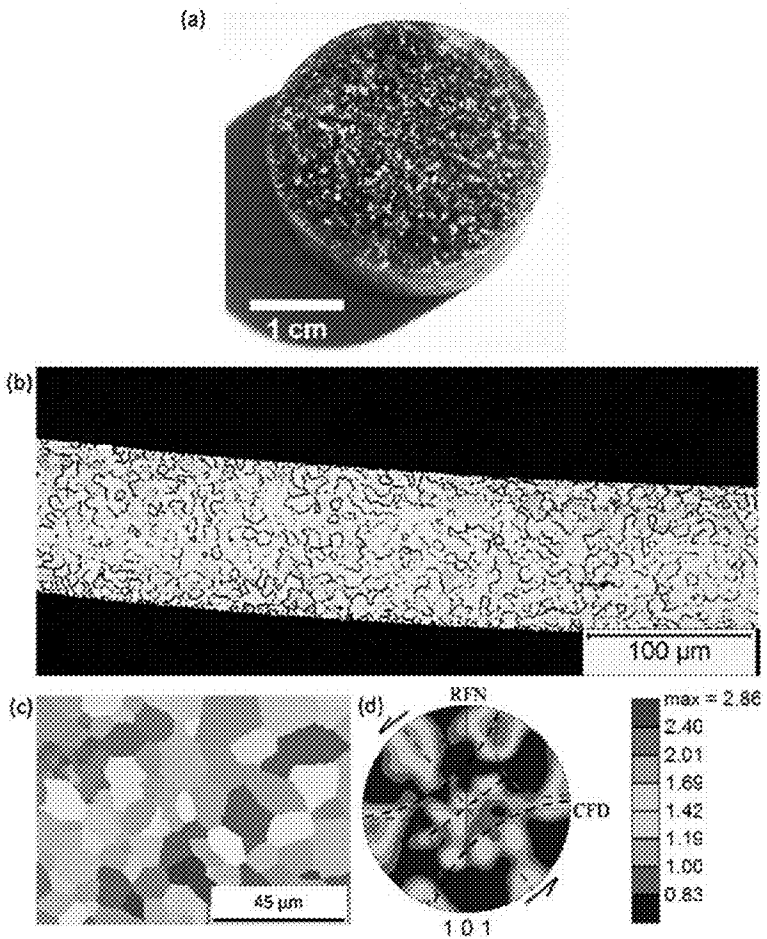
FIG. 11 includes four images (a, b, c, and d) that represent an as-cast ingot of an Fe—Si alloy having a Si content of 6.5 wt. % (image a), a micrograph of a thin strip machined directly from the as-cast ingot of image (a) (image b; λ=0.95, α=5%, $V_0$=3 m/s, and $T_0$=773 K (500° C.), $t_c$=95 μm), and an inverse pole figure map and a (101) pole figure of the recrystallized strip (images c and d, respectively).

Similar to the 4 wt. % Fe—Si alloy workpiece, sheets produced from the 6.5 wt. % Fe—Si alloy workpiece had a shear-type texture (image (d) of FIG. 11), with fibers rotated by 38° (counter-clockwise) from CFD, which again matched well with φ' of 46° for this deformation condition. Since similar sheets could be produced from both rolled and as-cast (initial) workpiece textures, it implies that starting microstructure and texture of the workpieces do not significantly influence the texture in the LSEM produced Fe—Si alloy sheets.

Figure 12:
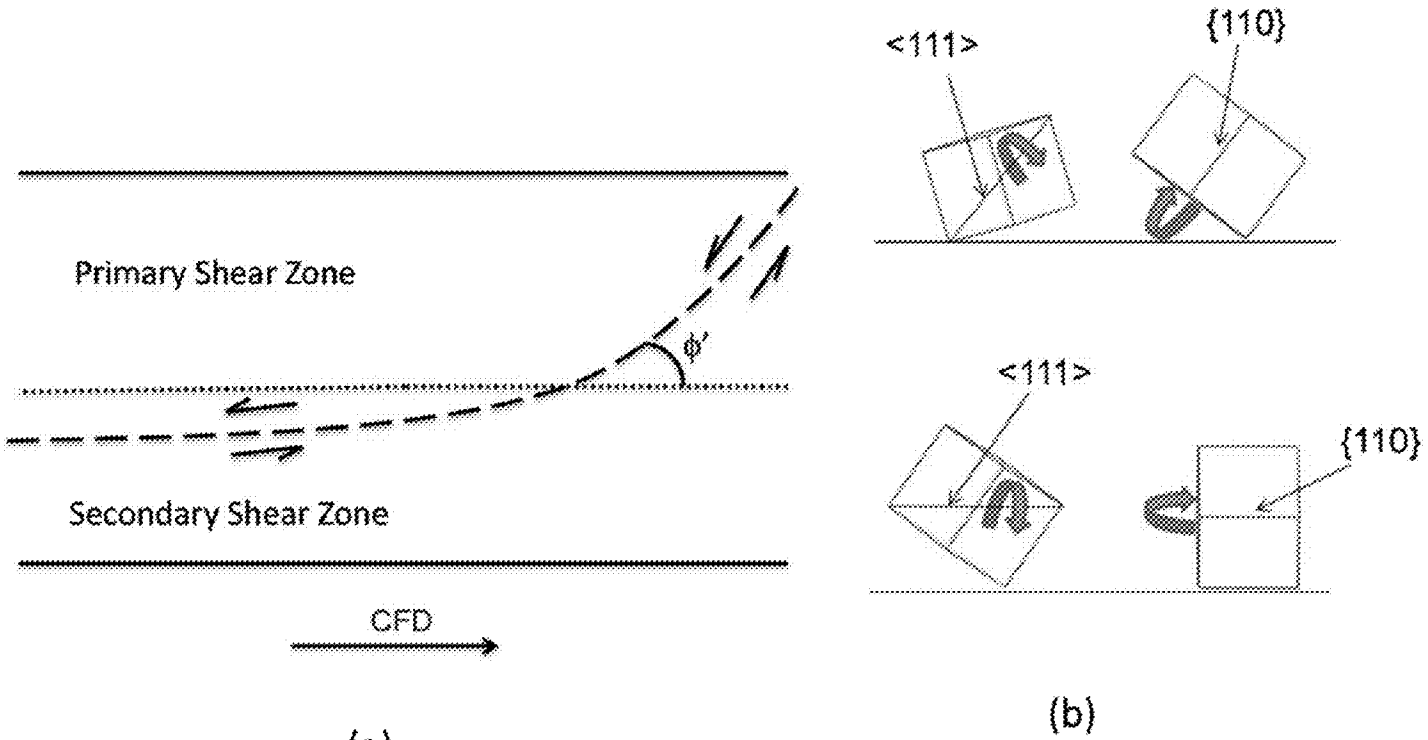
FIG. 12 includes two images (a and b) schematically representing fiber orientations (equivalent to φ') in the primary and secondary shear zones (shown in FIG. 10) viewed through a cross-sectional thickness of a hypothetical sheet formed of an Fe—Si alloy (image a), with extreme orientations possible in these zones represented in terms of the <111> and {110} fiber orientations (image b; primary shear zone above; secondary shear zone below).

FIG. 12 schematically represents extreme orientations of the accessible deformation paths. At one end, deformation conditions (κ>>1, α>0°) can be selected to rotate the shear fibers counterclockwise such that the <111> fiber becomes nearly perpendicular to the sheet normal (i.e., RFN) while the {110} fiber lies nearly parallel to the transverse direction (TD). This deformation path includes, among others, a cube-on-corner and 90-deg-rotated Goss ({110}//RFN and <001>//TD).

The other extreme ($\lambda<<1$, $\alpha<0°$) corresponds to smaller inclination angles of the shear plane and an increased secondary shear zone. This control of crystallographic orientation presents opportunities to tailor magnetic properties. For example, it is deleterious to have the <111> hard magnetization orientation in the plane of the Fe—Si alloy sheet. The LSEM shear deformation can, however, produce a sheet with a controlled <111> fiber orientation in Fe—Si alloys that could be beneficial for targeting a broader class of applications.

Figure 13:
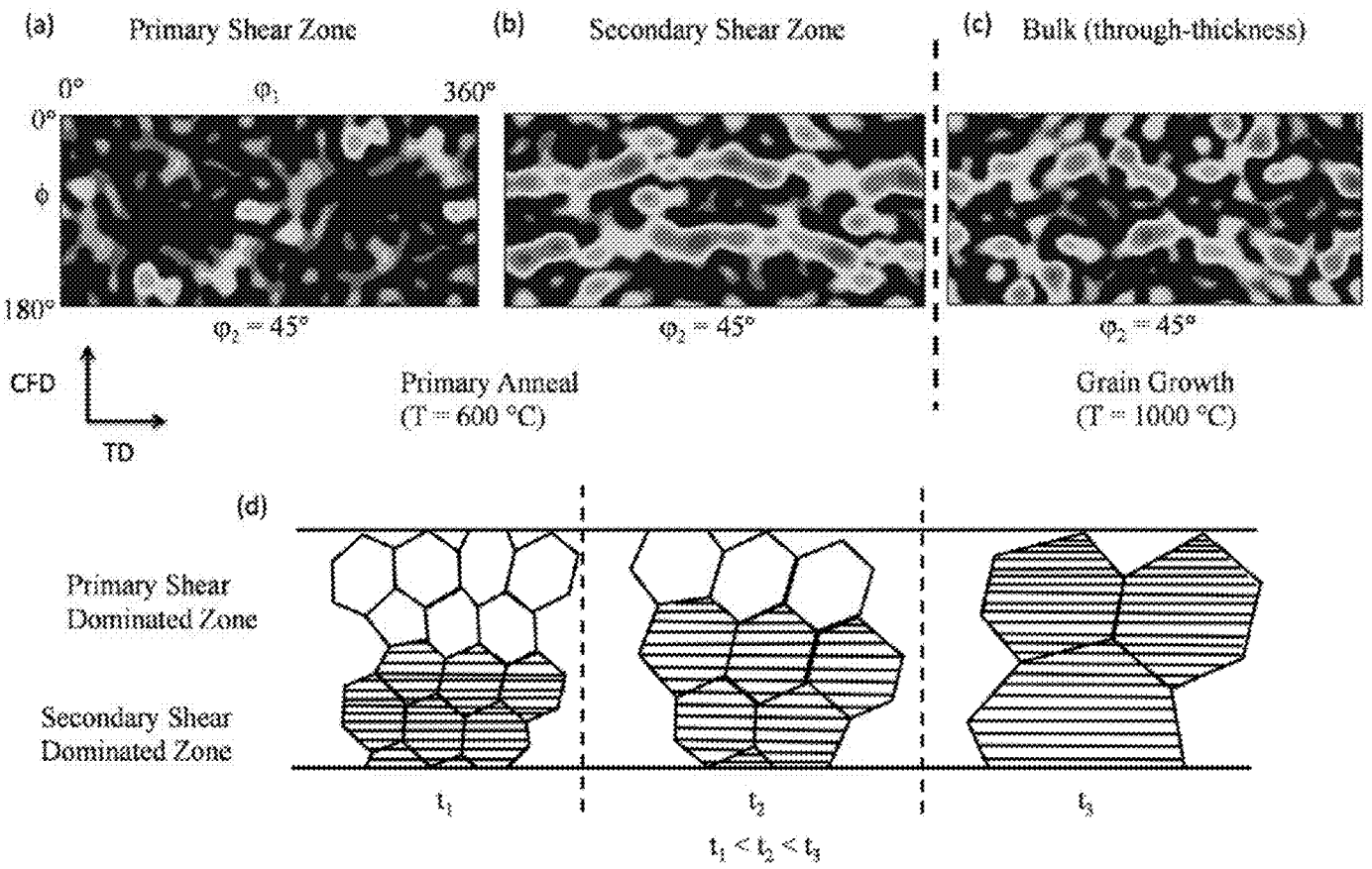
FIG. 13 includes four images (a, b, c, and d) representing the effects of high-temperature grain growth treatments performed on a sheet of an Fe—Si alloy produced via LSEM at relatively low speed (α=5°, λ=1, $V_0$=0.25 m/s). Images (a) and (b) represent orientation distribution functions (ODFs) of the primary and secondary shear zones, respectively, of the sheet after recrystallization annealing at 973 K (700° C.). ODF of the bulk section after high-temperature grain growth at 1273 K (1000° C.), represented in image (c), exhibits texture nearly identical to that of the secondary shear zone before grain growth (image b). A preferential growth of grains in the secondary shear zone, suggested for this texture evolution, is schematically represented in image (d).

Even in regions of the sheet with significant secondary shear, as at lower cutting velocities (FIG. 10), the texture was found to be retained following annealing. A detailed examination of these regions revealed a small amount of fine grains (d of about 15 μm) within 10° of the ideal Goss orientation. To explore Goss texture development, a high-temperature grain growth treatment at 1273 K (1000° C.) for five hours was conducted on the 4 wt. % Fe—Si alloy sheet produced at small deformation thickness ratio ($\lambda=1$). This treatment is similar to that used to develop the Goss texture in commercial rolled sheets. Following this high-temperature annealing, substantial grain growth was observed, resulting in only one to two grains in the sheet thickness ($t_c$=120 μm). However, unlike in rolled sheets, the grain growth was homogenous with no signs of abnormal grain growth (FIG. 13) of the type that would be necessary to produce the Goss orientation. Moreover, the texture after grain growth was reminiscent of the texture exhibited in the secondary sheared zone following recrystallization, as shown in FIG. 10. This observation indicated preferential growth of grains within the regions subjected to secondary shear, compared to those subjected to only primary shear. This result is illustrated by the texture measurements in FIG. 13, where sections of the orientation distribution function (ODF) (q=45°) are presented for both the recrystallization (images a and b of FIG. 13) and grain growth (image c of FIG. 13) treatments. It should be noted that the ODFs are presented with reference axes CFD and TD. The ODF of the sample that has undergone grain growth (image c of FIG. 13) shows the same high-intensity diffraction peaks as those in the secondary shear zone (image b of FIG. 13). Such texture could only develop if grains in the regions subjected to secondary shear grew more rapidly than those subjected to only primary shear, as illustrated schematically in image (d) of FIG. 13.

Figure 14:
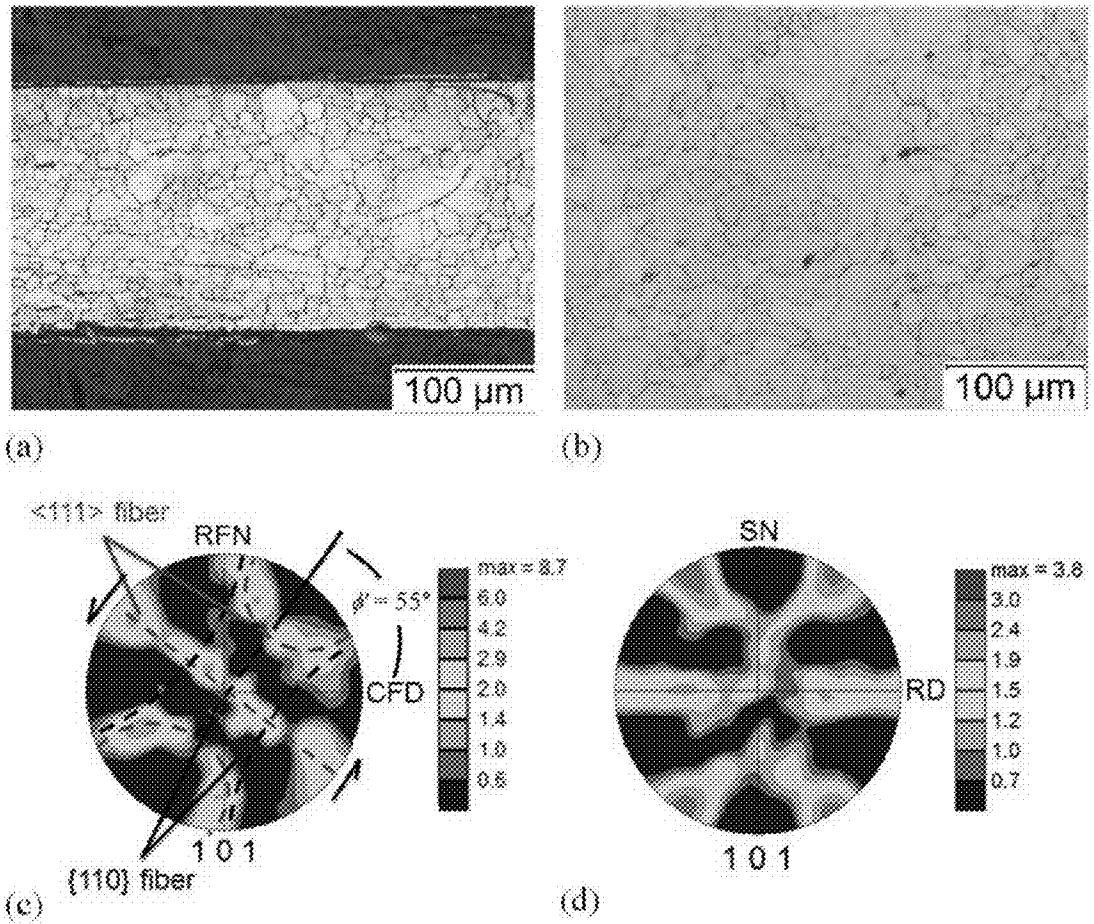
FIG. 14 includes four images (a, b, c, and d) comparing LSEM and rolled sheets formed from a 4 wt. % Fe—Si alloy. Images (a) and (b) are micrographs showing the microstructures of the LSEM and rolled sheets, respectively, and images (c) and (d) are pole figures representing the crystallographic texture of the LSEM and rolled sheets, respectively. Note that the simple shear texture of LSEM is tilted with respect to the sample axes by 55°, unlike the rolling texture.

In order to analyze the magnetic properties of Fe—Si alloy sheets produced by LSEM, two types of test samples were prepared from the 4 wt. % Fe—Si alloy; one by LSEM ($\bar{\varepsilon}$=1.2, ($\lambda$=1.5, $\alpha$=5°), $T_o$=25° C. and $V_o$=0.5 m/s) (referred to as the LSEM sheet) and one by rolling at 300° C. (referred to as the rolled sheet). Following the deformation processing, both the LSEM and rolled sheets were given a recrystallization annealing treatment at T=700° C. for thirty minutes to develop an equiaxed grain size (d) of about 25 μm. The resultant microstructures and textures of the two sheets after the annealing are shown in FIG. 14.

For both the LSEM and rolling sheets, the annealing treatment resulted in similar equiaxed grain size (d) of about 20 to 30 μm (images a and b). The texture measurements ({101} pole figures, images c and d) showed that each sheet possesses fundamentally different crystallographic textures. The LSEM sheet was characterized by two partial {110} and <111> fibers inclined relative to the sheet length (CFD) at $\varphi'$=55°, as measured from the pole figure. The rolled sheet had measured texture fibers $\gamma$ (<111>//normal direction) and $\alpha$ (<110>//rolling direction) (image d).

Magnetic properties were measured in the LSEM and rolled sheets after the annealing. Quasi-static hysteresis loops from single sheets were measured using an IEC 60404-4 standard closed-circuit permeameter. Magnetic properties, including maximum relative permeability ($\mu_{max}$), induction at H=60 kA/m (B60), coercivity ($H_c$), and hysteresis loss (W) were determined from the measured hysteresis loops. Sheet properties were gathered along the longitudinal directions, corresponding to the chip flow direction (CFD) for LSEM and rolling direction (RD) for rolling, respectively. Hysteresis loops were measured using an applied H field up to ±60 kA/m at room temperature. The rate of magnetization was controlled such that hysteresis loops were generated in about one minute and so as to maintain a constant change in induction with time.

Figure 15:
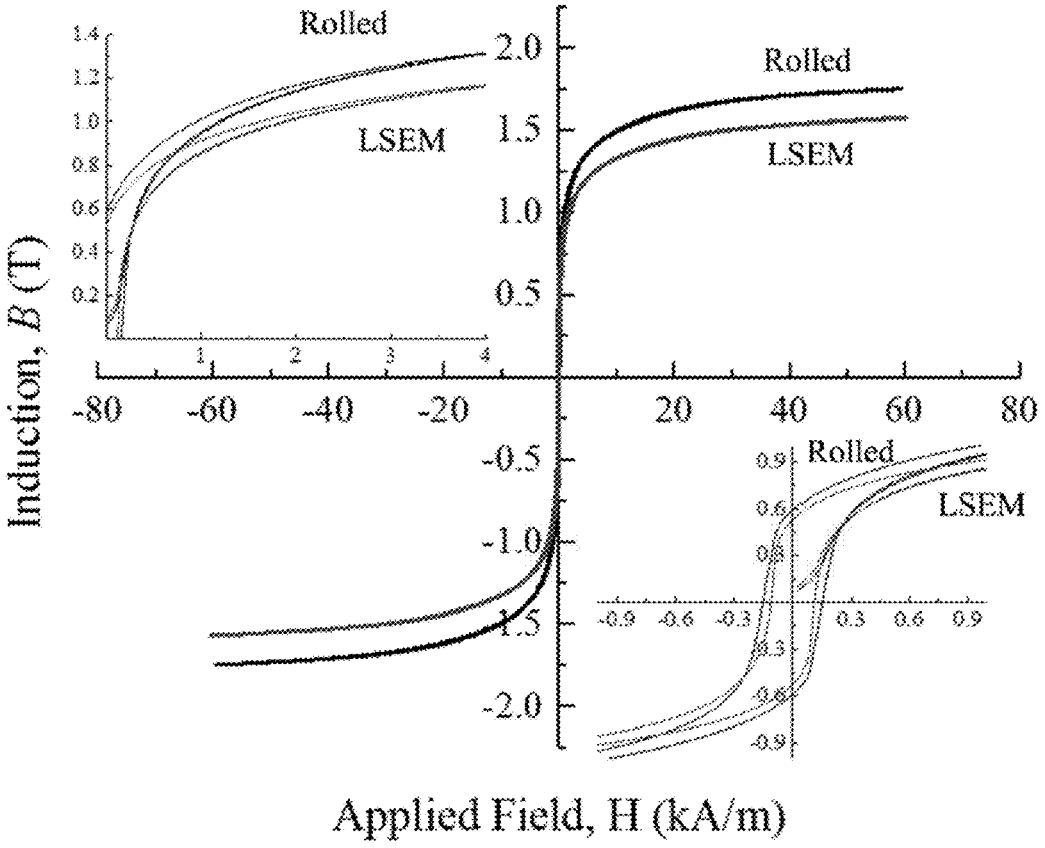
FIG. 15 is a hysteresis loop plot for a sheet formed by LSEM and a sheet formed by rolling. The upper left insert provides a magnified view of the upper right quadrant of the hysteresis loop plot, and the lower right insert provides a magnified view of the center of the hysteresis loop plot (1 kA/m). The hysteresis loop plot includes virgin magnetization curves, from which maximum relative permeability was calculated.

Full-field view of the B-H hysteresis loops for the LSEM and rolled sheets of the 4 wt. % Fe—Si alloy are shown in FIG. 15. The sheets revealed soft magnetic behavior with generally narrow hysteresis loop widths. Furthermore, high B values were achieved at relatively small H fields, indicative of fairly high permeability. Loops appeared to overlap closely with one another, indicating properties were not significantly different. Maximum relative permeability, full-field induction (at H=60 kA/m), coercivity, and hysteresis loss obtained from these loops are listed in Table 1.

TABLE 1

| Test Sample | Maximum Permeability, $\mu_{max}$ | Full-field Induction, $B_{60}$ (T) | Hc (A/m) | Hysteresis Loss, W (J/m$^2$) |
|---|---|---|---|---|
| LSEM | 1,698 | 1.58 | 111 | 401 |
| Rolled | 1,560 | 1.75 | 153 | 410 |

The upper left inset in FIG. 15 is a portion of the hysteresis loop at high applied H fields, where the LSEM condition is shown to require larger H fields to achieve the same B values. However, in spite of this, analysis of the maximum permeability revealed that the LSEM sheet possessed a somewhat larger maximum permeability, $\mu_{max}$=1,698, than the rolled condition, $\mu_{max}$=1,560, as measured from the virgin magnetization curve. At the maximum applied H field, both sheets exhibited large induction, with $B_{60}$=1.58 T for the LSEM sheet and $B_{60}$=1.75 T for the rolled sheet. In the lower right inset, the loops are shown near the origin of the B-H plot to detail the coercivity, where values were significantly smaller for the LSEM sheet, $H_c$=111 kA/m, than for the rolled sheet, $H_c$=153 kA/m. The coercivity differences, coupled with the lower B60 values for the LSEM sheet, led to similar hysteresis loss, with W=401 J/m$^3$ and W=410 J/m$^3$ for the LSEM and rolled conditions, respectively.

These measurements indicated that, overall, the differences in the magnetic properties between the LSEM and rolled sheets were minor. This suggested that the shear process did not develop textures that contain a particularly high degree of anisotropy along the sheet length compared to the conventional rolling textures. However, the properties of the LSEM sheet were in general more commercially desirable than those of the rolled sheet, with higher maximum permeability, lower coercivity, and lower hysteresis loss. These differences, while subtle, are impactful considering that the composition is identical and grain size nominally the same for the two processing conditions.

Texture heavily influences magnetic properties. For a commercial NGO sheet, textures are considered weak (near random), resulting in in-plane magnetic isotropy. A similar weak texture resulted in the rolled Fe-4 wt % Si. Both of these weak rolling textures, considered as typical BCC rolling textures with γ and α fiber components, are fundamentally different than the "tilted" shear-type texture of the LSEM sheet. Since the texture components of the LSEM sheet are fibers (rotated about direction or plane normal), consideration of the magnetically active <001> direction orientations along the full fiber is complex and is based on the relative strengths (intensities) of the two fibers. A feature of this type of texture is the inclination of the <001> directions relative to the applied field direction, which depend on the shear plane angle. For the particular case defined by $\varphi'=55°$ corresponding to the LSEM sheet, the orientations of the three main <001> easy magnetization directions away from the direction of the applied field are 48.3° and 70.3° for the <111> fiber and 54.6° and 55° for the {110} fiber, respectively. These orientations have a direct influence on the magnetic performance of shear-textured Fe—Si alloys.

Figure 16:
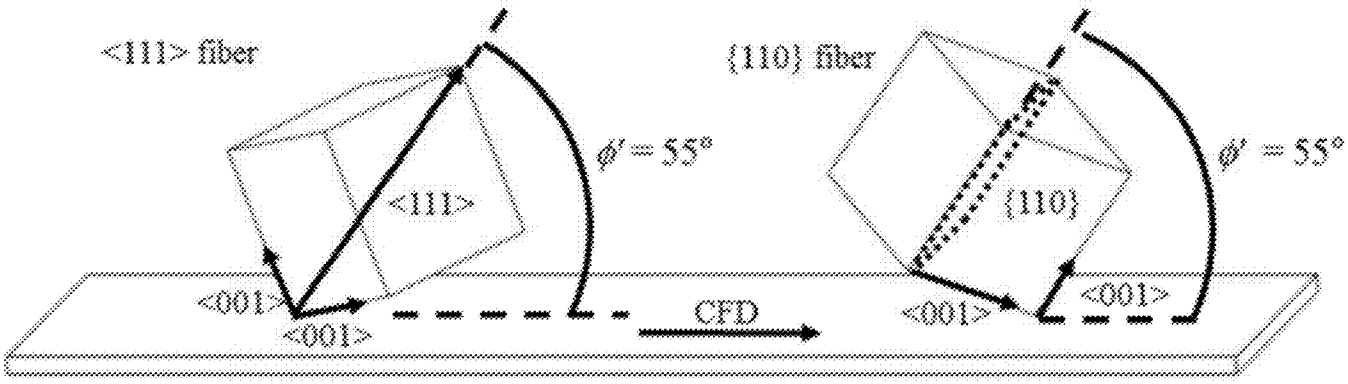
FIG. 16 schematically represents unit cells of the shear texture (<111> and {110} fiber orientations at a particular inclination of 55°) capable of being produced with LSEM.

Overall, the inclined <001> directions might be considered similar to those of the NGO and rolled sheets. However, unlike the rolled sheet, the tilted orientations of the <001> directions in an LSEM sheet can be controlled in a predictable manner. Since the orientation of the <001> directions with respect to the field direction vary significantly as a function of the shear plane angle for the two simple shear fibers, varying properties in shear-type textured Fe—Si alloy sheets must consider both the relative volume fractions of the {110} and <111> fibers and the shear plane orientation, as shown for a 55° inclination in FIG. 16. This is fundamentally different than for the rolled textures, where the γ fiber is generally minimized to promote the magnetic properties.

In view of the above, continuous sheets of, for example, 100-200 μm thickness, similar to that used in electrical applications (such as electric motors and power distribution transformers), can be produced from Fe—Si alloys of high Si content, for example, greater than 3.5 wt. % Si, using single step shear. By controlling the deformation path, a range of simple shear textures in the sheet may be selectively obtained. These textures are unlike those of rolled sheets. Although embodiments of the invention described herein predominately produced Fe—Si alloys having a Si content of greater than nominally about 4 wt. %, the process described above can be used to produce Fe—Si alloy sheets having a broad range of Si content, for example, in the range of between 0.1 to 13.0 weight percent with <111> and {110} partial fiber components that are inclined relative to the sheet. Preferred high silicon content Fe—Si alloy sheets include compositions having a Si content of between 4.5 and 8.5 wt. %, and more preferably about 6.5 wt. %.

It should be recognized that this process can result in annealing so that a wrought, annealed sheet is produced in a single step. The thickness of the sheets produced by the methods and principles of this disclosure can range from 20 micrometers to 2 millimeters or more. For example, for certain magnetic applications, the thickness required for the sheets ranges from 50 micrometers to 500 micrometers.

Although it is foreseeable that the workpiece may be previously subjected to deformation for a variety of reasons, in some cases, the workpiece may not have experienced any prior deformation processing. As a nonlimiting example, the workpiece may be subjected to hot rolling prior to LSEM, employed for homogenizing and/or refining grain structure.

A shear-texture gradation can be created in the sheet thickness by selectively enhancing frictional shear deformation at the sheet-tool interface in the LSEM process. Further in the LSEM process cracking and flow localization (shear banding) can be suppressed at large deformation strains (greater than one) and high strain rates (greater than $10^3$ $s^{-1}$) in favor of homogeneous deformation structures.

A particular aspect of this description is to disclose a continuous sheet of iron-silicon alloy having a shear texture wherein <111> and {110} partial fiber components are inclined relative to the sheet length. Another aspect of this description is to disclose a continuous sheet of iron-silicon alloy wherein the degree of inclination of the <111> and {110} partial fibers encompasses a range of 80° and the inclination is retained after subsequent annealing.

While the invention has been described in terms of specific embodiments, it is apparent that other forms could be adopted by one skilled in the art. For example, the physical configuration of the workpieces, sheets, and tools could differ from that shown, and materials and processes/methods other than those noted could be used. Therefore, the scope of the invention is to be limited only by the following claims.

The invention claimed is:

1. A process comprising:

deforming a solid body formed of an Fe—Si alloy with a cutting tool in a single step to continuously produce a continuous bulk form from material obtained from the solid body, the continuous bulk form having a longitudinal direction, a continuous cross-sectional form, and a microstructure characterized by a crystallographic texture having <111> and {110} fibers that are inclined relative to the longitudinal direction.

2. The process of claim 1, wherein the Fe—Si alloy has a Si content of greater than 3.5 wt. %.

3. The process of claim 1, wherein the continuous bulk form is a sheet product having opposite surfaces parallel to a direction in which the continuous bulk form travels during the deforming step.

4. The process of claim 1, wherein the <111> and {110} fibers have a degree of inclination that encompasses a range of 80°.

5. The process of claim 1, wherein the continuous bulk form has an annealed wrought microstructure as a result of the deforming step.

6. The process of claim 1, wherein the continuous bulk form comprises a primary shear zone and a secondary shear zone as a result of the deforming step, the process further comprising performing a thermal treatment on the continuous bulk form to preferentially grow grains in the secondary shear zone relative to grains in the primary shear zone.

7. The process of claim 1, further comprising selectively enhancing frictional shear deformation at an interface between the cutting tool and the continuous bulk form to create a shear-texture gradation in a thickness direction of the continuous bulk form.

8. The process of claim 1, further comprising controlling a degree of inclination of the <111> and {110} fibers by controlling a localized deformation temperature, wherein the localized deformation temperature is controlled by controlling:

a deformation velocity ($V_0$);

a preheating temperature of the solid body; and a deformation thickness ratio (λ) equal to $t_c/t_o$, where $t_c$ is a thickness of the continuous bulk form and $t_0$ is the depth of cut of the cutting tool.

9. The process of claim 1, further comprising installing the continuous bulk form in an electric motor or a power distribution transformer.

10. A process comprising:

deforming a solid body formed of an Fe—Si alloy with a cutting tool in a single step to continuously produce a continuous bulk form from material obtained from the solid body, the continuous bulk form having a longitudinal direction, a continuous cross-sectional form, and a microstructure characterized by a crystallographic texture, wherein the crystallographic texture is determined by simple shear deformation occurring during the deforming step; and either during the deforming step the continuous bulk form is dynamically recrystallized and the crystallographic texture is retained; or a thermal treatment is performed on the continuous bulk form to anneal and recrystallize the continuous bulk form and the crystallographic texture is retained.

11. The process of claim 10, wherein the continuous bulk form is dynamically recrystallized during the deforming step and the crystallographic texture is retained.

12. The process of claim 10, wherein the thermal treatment is performed on the continuous bulk form to anneal and recrystallize the continuous bulk form and the crystallographic texture is retained.

* * * * *